US011270877B2

(12) United States Patent
Guna

(10) Patent No.: US 11,270,877 B2
(45) Date of Patent: Mar. 8, 2022

(54) MULTIPOLE ION GUIDE

(71) Applicant: DH Technologies Development Pte. Ltd.

(72) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 23 days.

(21) Appl. No.: 16/628,065

(22) PCT Filed: Jun. 29, 2018

(86) PCT No.: PCT/IB2018/054864
§ 371 (c)(1),
(2) Date: Jan. 2, 2020

(87) PCT Pub. No.: WO2019/008488
PCT Pub. Date: Jan. 10, 2019

(65) Prior Publication Data

US 2021/0151307 A1 May 20, 2021

Related U.S. Application Data

(60) Provisional application No. 62/529,235, filed on Jul. 6, 2017.

(51) Int. Cl.
*H01J 49/06* (2006.01)
*H01J 49/24* (2006.01)

(52) U.S. Cl.
CPC ..... *H01J 49/063* (2013.01); *H01J 49/24* (2013.01)

(58) Field of Classification Search
CPC ..... H01J 49/063; H01J 49/24
See application file for complete search history.

(56) References Cited

U.S. PATENT DOCUMENTS

2012/0256082 A1 10/2012 Masujima et al.
2014/0374589 A1 12/2014 Javaheri et al.
2017/0125230 A1 5/2017 Yoshinari et al.
2017/0148620 A1 5/2017 Nishiguchi et al.
2018/0096832 A1* 4/2018 Hager ..... H01J 49/421

FOREIGN PATENT DOCUMENTS

WO 2016157032 A1 10/2016

OTHER PUBLICATIONS

International Search Report and Written Opinion for PCT/IB2018/054864 dated Oct. 31, 2018.

* cited by examiner

*Primary Examiner* — Nicole M Ippolito
*Assistant Examiner* — Hanway Chang

(57) ABSTRACT

Systems and methods described herein relate to a mass spectroscopy system having multipole ion guides that can receive ions from an ion source for transmission to downstream mass analyzers, while preventing unwanted ions from being transmitted into the high-vacuum chambers of mass spectrometer systems. At least one ion guide can have two or more auxiliary electrodes that extend along at least a portion of the ion guide. A power supply provides an RF voltage to the poles of the ion guide for radially confining the ions within the internal volume of the ion guide. The auxiliary electrodes are also provided with an auxiliary electrical signal that can selectively radially deflect from the internal volume at least a portion of low m/z ions so as to prevent transmission of undesired low m/z ions into the downstream mass analyzers.

21 Claims, 10 Drawing Sheets

MULTIPOLE ION GUIDE

RELATED APPLICATION

This application claims priority to U.S. provisional application No. 62/529,235 filed on 6 Jul. 2017 the content of which is incorporation herein by reference in its entirety.

FIELD

The present teachings are directed to mass spectrometry, and more particularly, to methods and systems for increasing the sensitivity of mass spectrometers and controlling ion flux being transmitted into the downstream section of mass spectrometer.

BACKGROUND

Mass spectrometry (MS) is an analytical technique often used for determining the elemental composition of test substances. Mass spectrometry can have quantitative and qualitative applications. For example, MS can be used to identify unknown compounds in a test substance, determine the isotopic composition of elements in a specific molecule, determine the structure of a particular compound by observing its fragmentation, and/or quantify the amount of a particular compound in a test sample.

Mass spectrometry generally involves converting sample molecules into ions using an ion source and separating and detecting the ions using one or more mass analyzers. Specifically, for most atmospheric pressure ion sources, ions pass through an inlet orifice of a mass spectrometer prior to entering an ion guide disposed in a vacuum chamber of the mass spectrometer. In most conventional mass spectrometer systems, a radio frequency (RF) signal applied to the ion guide provides collisional cooling and radial focusing along the central axis of the ion guide as the ions are transported into a subsequent, lower-pressure vacuum chamber in which the mass analyzer(s) are disposed.

Ionization at atmospheric pressure (e.g., by chemical ionization, electrospray) is generally a highly efficient means of ionizing molecules within the sample. However, the process that generates ions of analytes of interest also typically generates interfering/contaminating ions as well as residual or recombinant neutral molecules. Although increasing the size of the inlet orifice between the ion source and the ion guide can increase the number of ions of interest entering the ion guide (thereby potentially increasing the sensitivity of MS instruments), such a configuration can also allow more of these unwanted molecules to enter the vacuum chamber and potentially downstream mass analyzer stages located deep inside high-vacuum chambers, where trajectories of the ions of interest must be precisely controlled by electric fields.

Transmission of undesired/unwanted ions and neutral molecules can contaminate these downstream elements. This contamination of the downstream elements can, in turn, interfere with mass spectrometric analysis, increase the costs associated with the maintenance of the mass spectrometer, or decrease the throughput of the mass spectrometer necessitated by the cleaning of critical components within the high-vacuum chamber(s).

Most ion optics (e.g., lenses) of mass spectrometry systems are inherently subject to ions and neutrals deposition and can, therefore, exhibit significantly different behavior following substantial contamination (e.g., loss of sensitivity). Accordingly, fouled surfaces must be regularly cleaned to maintain sensitivity. While the surfaces of front-end components (e.g., curtain plates, orifice plates, Qjet ion guide, IQ0) can be relatively accessible and easy to clean, the fouling of components contained within the downstream high-vacuum chambers (e.g., Q0, Q1, IQ1) can result in substantial time and/or expense as the vacuum chambers must be vented and substantially disassembled prior to cleaning.

Accordingly, there remains a need for improved methods and systems for reducing contamination in downstream mass analyzers.

SUMMARY

The present disclosure relates to apparatuses and corresponding methods for increasing sensitivity of mass spectrometry instruments and/or for reducing contamination in high-vacuum chambers of a mass spectrometer system. The mass spectrometer sensitivity can often be increased by increasing the area of the sampling orifice. However, an increase in the area of sampling orifice can also increase the size of the ion population that is transferred through the mass spectrometer. Large ion populations can, in turn, increase the rate of contamination of downstream optics of the mass spectrometer. In accordance with various aspects of the present teachings, the systems and methods disclosed herein can allow for increased sensitivity by selectively transferring the ions of interest (e.g., ions having specific mass/charge (m/z) ratios) to the downstream portions of the analyzer, while disregarding ions that are not of interest that can serve as a source of fouling of downstream mass spectrometer components. In various aspects, the ion guides disclosed herein can act as a high-pass filter in the upstream section so as to selectively allow transmission of ions of interest into the downstream mass analyzer.

In various aspects, systems disclosed herein can employ an ion guide (e.g., Qjet ion guide or double Qjet ion guide) having a plurality of auxiliary electrodes included therein can be utilized in a high-pressure region (e.g., maintained at 100 milliTorr to 10 Torr and/or free jet expansion chamber). Ion guides operated in free jet expansion regions can mechanically confine an effusing beam, because ion dynamics in the free jet expansion region are generally gas-flow dominated. Toward the rear-end of the ion guide, the confining RF fields can start to have a strong effect on ion confinement because in that region (i.e., towards the end of the ion guide) the gas flow and the translational energy of the ion beam both decrease. The high pressure region can be a vacuum chamber and the ion guide can be included in the vacuum chamber such that it extends, along a central longitudinal axis, from a proximal end, disposed adjacent to an inlet aperture of the vacuum chamber, to a distal end, disposed adjacent to an outlet aperture of the vacuum chamber. The ion guide can comprise a plurality of rods, and the rods can be configured such that they extend along the longitudinal axis of the ion guide and define an internal cavity for the ion guide. The ions received by the ion guide are generally entrained within this internal cavity by a flow of gas and radially confined by the generation of a RF field by the ion guide. Generally, light components (e.g., ions having lower mass to charge ratios) experience a greater amount of lateral beam spreading in the free jet expansion region than heavier components (e.g., ions having higher mass to charge ratios). To prevent contamination of the downstream elements of the spectrometer by such low m/z ions, systems in accordance with various aspects of the present teachings herein utilize an electrical signal applied to the plurality of auxiliary electrodes included in ion guides operating in a high-pressure region that can selectively affect the ion trajectory of low m/z ions, on demand, while substantially maintaining the entire population of high m/z ions within the volume defined by the ion guide.

In some particular aspects, systems in accordance with the present teachings can control the ion flux transmitted to the downstream portions of the mass spectrometer by utilizing auxiliary electrodes disposed between the rods of a quadrupole ion guide, the auxiliary electrodes being configured to radially deflect the low m/z ions subject to lateral beam spreading so as to prevent their transmission to the downstream components of the mass spectrometer system. In various aspects, two or more auxiliary electrodes can be utilized and the electrodes can assume various shapes (e.g., round, T-shaped, thin bars, blade electrodes). By way of non-limiting example, the auxiliary electrodes can exhibit a T-shaped cross-sectional area. In various aspects, the rods of the quadrupole ion guide can have a profile that tapers along the longitudinal axis of the ion guide, which can increase the space between the rods in the proximal end of the ion guide so as to allow for increased expansion of the gas used to entrain the ions of interest in the region adjacent the inlet orifice, and thus subject the low m/z ions to increased strength of the deflecting field generated by the auxiliary electrodes. For example, in some aspects, the rods of the ion guide can be configured such that they have a half-round-half-square profile near the inlet aperture of the vacuum chamber in which the ion guide is disposed. The rods can further be configured to assume this half-round-half-square shape for a certain length along the length of the ion guide. For example, the rods can be configured to assume the half-round-half-square shape for approximately 8.5 centimeters (cm) along the length of the ion guide. Alternatively or additionally, the rods can assume a tapered shape such that for the remainder of the length of the electrode, they assume a cylindrical shape. For example, the rods can assume a cylindrical shape for the last 4.0 cm along the length of the ion guide.

Systems in accordance with various aspects of the present teachings can reduce contamination in the downstream components of a mass spectrometry system by selectively filtering the ions that travel through the mass spectrometer based on their mass to charge density, and preventing ions having charge to mass densities that fall out of the desired range from going through the downstream elements of spectrometer. Specifically, the electrical voltage applied to the rods and the auxiliary electrodes can be controlled to ensure that the ions having mass to charge densities that fall out of the desired range interest are repelled by the electrodes and, thereby, prevented from being transferred into and/or contaminating the downstream sections of the mass spectrometer. For example, the quadrupole rods can comprise a first and second pair of rods that are generally configured to provide a radially-confining electric field (e.g., a quadrupole electric field) to radially focus the ions entering the ion guide. By way of example, an RF voltage having a first frequency and at a first phase can be applied to a first pair of rods and a RF voltage having the same frequency as the first frequency and a second phase can be applied to the other pair of rods. A DC voltage can simultaneously be applied to the auxiliary electrodes by the power supply that it is of the same or different polarity as the polarity of ions to be filtered (e.g., the low m/z ions) such that the auxiliary electrodes remove (e.g., radially deflect, attract, repel) the low m/z ions from within the volume confined by the quadrupole field such that these ions are prevented from being transmitted into downstream components. Generally, ions having lower m/z are subjected to increased radial spreading during the free jet expansion and can be more easily deflected by the field generated by the auxiliary electrode. It will be appreciated in view of the present teachings that the identity and/or amount of ions that are prevented from entering downstream components can depend on various factors including the ion population, the size of the electrodes, and the voltage applied to the electrodes. Any number of auxiliary electrodes can be used with the embodiments disclosed herein. For example, in some implementations 2 or 3 auxiliary electrodes can be utilized. The auxiliary electrodes can have similar polarities as the ions being filtered. For example, if the auxiliary electrodes are positively charged, they can repel positive ions of low m/z ratios from the central longitudinal axis and prevent these ions from entering the downstream components of the spectrometer. Although positive ions of higher m/z ratios are also subject to the repulsive field, the effect of this field on the trajectory of these higher m/z ions through the ion guide is reduced relative to the low m/z ions due to the reduced radial expansion of the high m/z ions during the free jet expansion and the decreased effect of the asymmetric field on the high m/z ions. Alternatively, if the auxiliary electrodes are negatively charged, they can attract positive ions of low m/z ratios from the central longitudinal axis and prevent these ions from entering the downstream components of the spectrometer. In some aspects, DC voltages of different polarities can be applied to different auxiliary electrodes such that one or more auxiliary electrodes repel ions of a certain polarity while other of the auxiliary electrodes attract these same ions. Accordingly, it will be appreciated by those skilled in the art that by controlling the voltage and polarity of the auxiliary electrodes, the present teaching can selectively allow ions of interest (e.g., ions having certain mass/charge densities) to enter the cavity of the ion guide.

In accordance with various aspects of the present teachings, a mass spectrometer system is provided that can comprise an ion source, a first vacuum chamber, at least one ion guide disposed within the first vacuum chamber, a power supply coupled to the at least one ion guide, and a second vacuum chamber maintained at a lower pressure relative to the first vacuum chamber. The ion source generates ions, from a sample of interest, in a high-pressure region. The first vacuum chamber can be maintained at a pressure above about 500 mTorr. The first vacuum chamber can extend between an inlet aperture and an exit aperture. The inlet aperture can receive the ions generated by the ion source from the high-pressure region, and the exit aperture can be positioned downstream from the inlet aperture and configured to transmit at least a portion of said ions from the first vacuum chamber to the second vacuum chamber. The at least one ion guide can be disposed within the first vacuum chamber between the inlet aperture and the exit aperture. The ion guide comprises a plurality of rods and a plurality of auxiliary electrodes. The plurality of rods can comprise at least a first pair of rods and a second pair of rods that extend along a central longitudinal axis from a proximal end disposed adjacent the inlet aperture to a distal end, the plurality of rods spaced apart from the central longitudinal axis and defining an internal volume within which the ions received through the inlet aperture are entrained by a flow of gas. The plurality of auxiliary electrodes can extend along at least a portion of the ion guide, and each of the auxiliary electrodes can be interposed between a single rod of the first pair of rods and a single rod of the second pair of rods. The power supply is coupled to the ion guide and can be configured to provide electrical signals to various components of the ion guide. For example, the power supply can be configured to provide a first RF voltage at a first frequency and a first phase to the first pair of rods and a second RF voltage at the first frequency and a second phase to the second pair of rods for radially confining the ions within the internal volume. The power supply can be further configured to provide an auxiliary electrical signal to at least one of the auxiliary electrodes to selectively radially deflect from the internal volume at least a portion of low m/z ions so as to prevent transmission of said low m/z ions through the exit aperture.

In other examples, any of the aspects above, or any system, method, apparatus described herein can include one or more of the following features.

The power supply can apply a substantially identical electric DC voltage to each auxiliary electrodes. Alternatively or additionally, the power supply can apply to at least one auxiliary electrode a DC voltage different from a DC voltage applied to other auxiliary electrodes. The DC voltage applied to each auxiliary electrode can be of same polarity as the low mass ions. Further, the DC voltage applied to the auxiliary electrodes can be different from a DC offset voltage at which the plurality of rods are maintained.

The mass spectrometer can also comprise a controller that can be configured to modify the electric field, for example, so as to increase repulsion of the low m/z ions by the plurality of auxiliary electrodes by adjusting the DC voltage applied to the auxiliary electrodes relative to a DC offset voltage at which the plurality of rods are maintained. In such aspects, for example, the controller can be configured to attenuate low m/z ions transmitted from the ion guide by increasing the DC voltage applied to the auxiliary electrodes. Additionally or alternatively, the controller can adjust a m/z range of ions transmitted from the ion guide by adjusting the DC voltage applied to auxiliary electrodes.

In various aspects, the configuration of the inlet aperture and a pressure difference between the ion source and the vacuum chamber can provide a supersonic free jet expansion downstream of the inlet aperture, the free jet expansion comprising a barrel shock of predetermined diameter, which in some aspects can substantially correspond to diameter of the inner surface of the rods disposed about the central longitudinal axis.

In various aspects, the plurality of rods can comprise a quadrupole rod set, though more rods can also be provided (e.g., as a hexapole ion guide, an octapole ion guide). The rods can have a variety of cross-sectional shapes (e.g., round, parabolic, square) that is substantially constant along their length, though in some exemplary aspects the rods can exhibit a profile that tapers along the length of the longitudinal axis of the ion guide so as to allow for increased radial expansion in the region of the inlet aperture. In some aspects, each of the plurality of rods can exhibit a non-circular cross section at their proximal end and a circular cross-section at their distal end. For example, in some aspects, the rods of the ion guide can be configured such that they have a half-round-half-square profile near the inlet aperture of the vacuum chamber in which the ion guide is disposed. The rods can further be configured to assume this half-round-half-square shape for a certain length along the length of the ion guide.

In some aspects, the high-pressure region (the ionization chamber) can be maintained at substantially atmospheric pressure, while the first vacuum chamber can be maintained at a pressure in a range from about 0.5 Torr to about 50 Torr. Alternatively in some aspects, the first vacuum chamber can be maintained at a pressure in a range from about 10 Torr to about 50 Torr.

The auxiliary electrodes can have a length less than a length of the rods of the plurality of rods. By way of non-limiting example, while the rods can have a length greater than about 10 centimeters, the auxiliary electrodes can have a length along the longitudinal axis of about 1 cm. Additionally in some aspects, the auxiliary electrodes can be disposed closer to the inlet aperture such that the distal end of the plurality of auxiliary electrodes can be proximal to the distal end of the plurality of rods. By way of example, the auxiliary electrodes can be disposed about 3 cm from in inlet aperture. Additionally or alternatively, the plurality of auxiliary electrodes can have a variety of cross sectional shapes (e.g., round, square, blades, etc.) though in exemplary aspects can exhibit a T-shaped cross-sectional shape.

The mass spectrometer can further include a mass analyzer that receives the ions transmitted from the first vacuum chamber. The mass spectrometer can also include a second ion guide disposed within the first vacuum chamber along the central longitudinal axis. The second ion guide can comprise a second plurality of rods extending between a proximal end disposed adjacent the distal end of the first plurality of rods and a distal end disposed adjacent the exit aperture. The second ion guide can comprise a quadrupole rod set.

Other aspects and advantages of the invention can become apparent from the following drawings and description, all of which illustrate the principles of the embodiments disclosed herein, by way of example only.

BRIEF DESCRIPTION OF DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

The term "about" and "substantially identical" as used herein, refers to variations in a numerical quantity that can occur, for example, through measuring or handling procedures in the real world; through inadvertent error in these procedures; through differences/faults in the manufacture of electrical elements; through electrical losses; as well as variations that would be recognized by one skilled in the art as being equivalent so long as such variations do not encompass known values practiced by the prior art. Typically, the term "about" means greater or lesser than the value or range of values stated by 1/10 of the stated value, e.g., ±10%. For instance, applying a voltage of about +3V DC to an element can mean a voltage between +2.7V DC and +3.3V DC. Likewise, wherein values are said to be "substantially identical," the values may differ by up to 5%. Whether or not modified by the term "about" or "substantially" identical, quantitative values recited in the claims include equivalents to the recited values, e.g., variations in the numerical quantity of such values that can occur, but would be recognized to be equivalents by a person skilled in the art.

Figure 1:
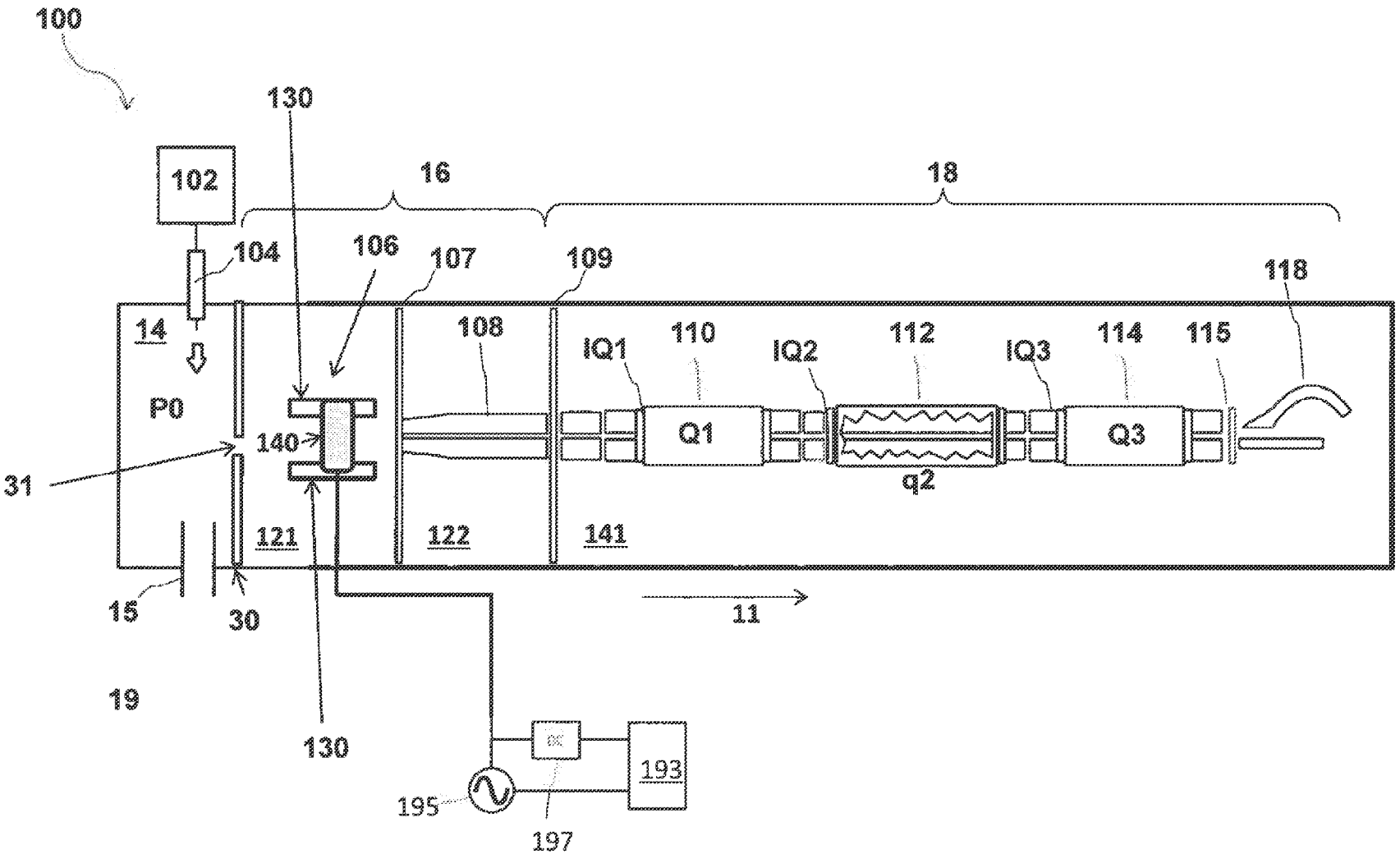
FIG. 1 schematically depicts an exemplary mass spectrometer system in accordance with various aspects of embodiments of the applicant's teachings.

Methods and corresponding systems for preventing contamination of components within the chambers of mass spectrometer systems are described herein. A mass spectrometer system according to the embodiments disclosed herein can comprise one or more ion guides, operated within a high-pressure region, that can preferentially deflect low mass ions, while the trajectory of the relatively high-mass ions remains closer to central longitudinal axis of ion guide. FIG. 1 schematically depicts a mass spectrometer system 100 in accordance with various aspects of the present teachings that can allow for increased sensitivity and/or to selectively prevent ions that are not of interest (e.g., low m/z ions) from being transmitted into downstream high-vacuum mass spectrometer components, by way of non-limiting example. As shown, the exemplary mass spectrometer system 100 can comprise an ion source 104 for generating ions within an ionization chamber 14, an upstream section 16, and a downstream section 18. The upstream section 16 is configured to perform initial processing of ions received from the ion source 104, and includes various elements such as a curtain plate 30 and one or more ion guides 106, 108. The downstream section 18 includes one or more mass analyzers 110, 114, a collision cell 112, and a detector 118. As discussed in detail below, an ion guide 106 in accordance with various aspects of the present teachings can include a plurality of auxiliary electrodes that can be configured to radially deflect from the internal volume of the ion guide 106 at least a portion of low m/z ions so as to prevent transmission of such ions into the downstream, high-vacuum portion 18 of the mass spectrometer system 100.

The ion source 104 can be any known or hereafter developed ion source for generating ions and modified in accordance with the present teachings. Non-limiting examples of ion sources suitable for use with the present teachings include atmospheric pressure chemical ionization (APCI) sources, electrospray ionization (ESI) sources, continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others. Additionally, as shown in FIG. 1, the system 100 can include a sample source 102 configured to provide a sample to the ion source 104. The sample source 102 can be any suitable sample inlet system known in the art. By way of example, the ion source 104 can be configured to receive a fluid sample from a variety of sample sources, including a reservoir containing a fluid sample that is delivered to the sample source (e.g., pumped), a liquid chromatography (LC) column, a capillary electrophoresis device, and via an injection of a sample into a carrier liquid. In the example depicted in FIG. 1, the ion source 104 comprises an electrospray electrode (not shown), which can comprise a capillary fluidly coupled to the sample source 102 (e.g., through one or more conduits, channels, tubing, pipes, capillary tubes, etc.), and which terminates in an outlet end that at least partially extends into the ionization chamber 14 to discharge the liquid sample therein. The ion source 104 can be electrically coupled to a power supply that provides suitable voltage to the ion source 104. In addition to supplying the ion source 104 with voltage, the one or more power supplies can supply power to other components of the system 100. For example, the system can include a second power supply (e.g., including an RF power supply 195 and DC power supply 197) that can be controlled by a controller 193 so as to apply electric potentials having RF, AC, and/or DC components to the various components of the system 100, as discussed in detail below. Further, the ion source 104 can be nebulizer-assisted or non-nebulizer assisted. In some embodiments, ionization can also be promoted with the use of a heater, for example, to heat the ionization chamber so as to promote dissolution of the liquid discharged from the ion source.

Referring back to FIG. 1, the analytes, contained within the sample discharged from the ion source 104, can be ionized within the ionization chamber 14. The ionization chamber 14 is separated from the upstream section 16 by the curtain plate 30. The curtain plate 30 can define a curtain plate aperture 31, which is in fluid communication with the upstream section 16. Although not shown in FIG. 1, the system 100 can include various other components. For example, the system 100 can include a curtain gas supply (not shown) that provides a curtain gas flow (e.g., of $N_2$) to the upstream section 16 of the system 100. The curtain gas flow can aid in keeping the downstream section 18 of the mass spectrometer system 100 clean (e.g., by de-clustering and evacuating large neutral particles). For example, a portion of the curtain gas can flow out of the curtain plate aperture 31 into the ionization chamber 14, thereby preventing the entry of droplets and/or neutral molecules through the curtain plate aperture 31.

The ionization chamber 14 can be maintained at a pressure P0, which can be the atmospheric pressure or a substantially atmospheric pressure. However, in some embodiments, the ionization chamber 14 can be evacuated to a pressure lower than atmospheric pressure. The ions generated by the ion source 104 can be successively transmitted through the elements of the upstream section 16 (e.g., curtain plate 30, ion guide 106, and ion guide 108) to result in a narrow and highly focused ion beam (e.g., in the z-direction along the central longitudinal axis of the system 100) for further mass analysis within the downstream portion 18. The upstream portion 16 of the system can be housed within one or more vacuum chambers 121, 122. Similarly, the downstream portion 18 of the system can be housed within at least one vacuum chamber 141.

The ions generated by the ion source 104, upon entering the upstream section 16 can traverse one or more additional vacuum chambers 121, 122 and/or ion guides 106, 108 (e.g., quadrupoles such as in the QJet® ion guide as modified in accordance with the present teachings). These components (e.g., vacuum chambers 121, 122 and ion guides 106, 108) provide additional focusing of and finer control over the ion beam using a combination of gas dynamics and radio frequency fields prior to being transmitted into the downstream high-vacuum section 18.

Referring still to FIG. 1, the ion guide 106 (also referenced hereinafter as "QJet ion guide") transfers the ions received thereby to subsequent ion optics such as ion guide 108 (also referenced hereinafter as "Q0") through an ion lens 107 (also referenced hereinafter as "IQ0"). The ions can be transmitted from ion guide 106 through an exit aperture in the ion lens 107. The ion guide Q0 108 can be an RF ion guide and comprise a quadrupole rod set. This ion guide 108 can be positioned in a second vacuum region and arranged to transports ions through an intermediate pressure region (e.g., in a range of about 3 mTorr to about 15 mTorr) and delivers ions through the subsequent optics (IQ1 lens) 109 to the downstream section 18 of system 100.

Further, as shown in FIG. 1, the ion guide Q0 108 can be situated in a vacuum chamber 122 that can be evacuated to a pressure that can be maintained lower than that of first vacuum chamber 121. For example, the second vacuum chamber 122 can be maintained at a pressure of about 3 to 15 mTorr, although other pressures can be used for this or for other purposes.

Ions passing through the quadrupole rod set Q0 can pass through the lens IQ1 and into the adjacent quadrupole rod set Q1 110 in the downstream section 18. After being transmitted from Q0 through the exit aperture of the lens IQ1, the ions can enter the adjacent quadrupole rod set Q1, which can be situated in a vacuum chamber 141 that can be evacuated to a pressure that can be maintained lower than that of ion guide Q0 and Qjet ion guide chambers (first and second vacuum chambers 121, 122). For example, the vacuum chamber 141 can be maintained at a pressure less than about $1\times10^{-4}$ Torr (e.g., about $5\times10^{-5}$ Torr), though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. For example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, the lens IQ2 between Q1 110 and Q2 112 can be maintained at a much higher offset potential than Q1 such that the quadrupole rod set Q1 can be operated as an ion trap. In such a manner, the potential applied to the entry lens IQ2 can be selectively lowered (e.g., mass selectively scanned) such that ions trapped in Q1 can be accelerated into Q2, which could also be operated as an ion trap, for example.

Ions passing through the quadrupole rod set Q1 can pass through the lens IQ2 and into the adjacent quadrupole rod set Q2, which as shown can be disposed in a pressurized compartment and can be configured to operate as a collision cell at a pressure approximately in the range of from about 1 mTorr to about 10 mTorr, though other pressures can be used for this or for other purposes. A suitable collision gas (e.g., nitrogen, argon, helium, etc.) can be provided by way of a gas inlet (not shown) to thermalize and/or fragment ions in the ion beam.

Ions that are transmitted by Q2 can pass into the adjacent quadrupole rod set Q3, which is bounded upstream by IQ3 and downstream by the exit lens 115. As will be appreciated by a person skilled in the art, the quadrupole rod set Q3 can be operated at a decreased operating pressure relative to that of Q2, for example, less than about $1\times10^{-4}$ Torr (e.g., about $5\times10^{-5}$ Torr), though other pressures can be used for this or for other purposes. As will be appreciated by a person skilled in the art, Q3 can be operated in a number of manners, for example as a scanning RF/DC quadrupole or as a linear ion trap. Following processing or transmission through Q3, the ions can be transmitted into the detector 118 through the exit lens 115. The detector 118 can then be operated in a manner known to those skilled in the art in view of the systems, devices, and methods described herein. As will be appreciated by a person skill in the art, any known detector, modified in accord with the teachings herein, can be used to detect the ions.

Although, for convenience, the mass analyzers 110, 114 are described herein as being quadrupoles having elongated rod sets (e.g., having four rods), a person of ordinary skill in the art should appreciate that the mass analyzers 110, 114 can have other suitable configurations. It will also be appreciated that the one or more mass analyzers 110, 114 can be any of triple quadrupoles, linear ion traps, quadrupole time of flights, Orbitrap or other Fourier transform mass spectrometers, all by way of non-limiting examples.

Figure 2:
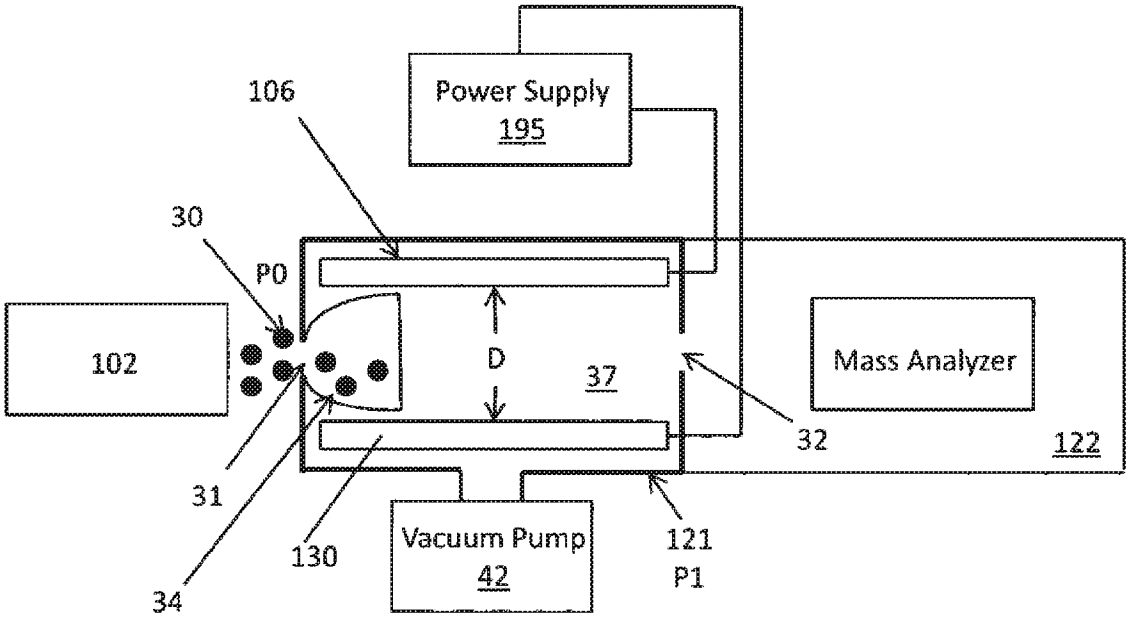
FIG. 2 is a high-level schematic illustration of exemplary components that can be included in a first vacuum chamber of a mass spectrometer system according to various aspects of the present teachings.

As noted above, the generated ions travel towards the vacuum chambers 121, 122, 141, in the direction indicated by the arrow 11 in FIG. 1. FIG. 2 is a high-level schematic illustration 200 of the mass spectrometry system 100 shown in FIG. 1 that illustrates the components that can be included in the first vacuum chamber 121. As shown in FIG. 2, the ions can enter the first vacuum chamber 121 through an inlet aperture 31, where the ions are entrained by a supersonic flow of gas, typically referred to as a supersonic free jet expansion 34, as described in detail in U.S. patent application Ser. No. 11/315,788 (U.S. Pat. No. 7,259,371), the entire teachings of which is described herein by reference.

As shown in FIG. 2, the first vacuum chamber 121 can comprise an exit aperture 32 located downstream from the inlet aperture 31. The ion guide 130 is positioned between the inlet aperture 31 and the outlet aperture 32, and is configured for radially confining, focusing and transmitting at least a portion of the ions 30 from the supersonic free gas jet 34. The exit aperture 32 can be an inter-chamber aperture separating the first vacuum chamber 121 from the next or second vacuum chamber 122 that can house additional ion guides or mass analyzers as will be described below.

The pressure P1 in the first vacuum chamber 121 can be maintained by pump 42, and power supply 195 can be connected to the various components of the ion guide 106 to provide for selective transmission of a portion of the ions as otherwise discussed herein. The ion guide 106 can be a set of quadrupole rods 130 with a predetermined cross-section characterized by an inscribed circle with a diameter as indicated by reference letter D (also shown in FIG. 3), extending along the axial length of the ion guide 106 to define an internal volume 37. The ions 30 can initially pass through an orifice-curtain gas region, generally known in the art for performing desolvation and blocking unwanted particulates from entering the vacuum chamber 121, but for the purpose of clarity, this is not shown in FIGS. 1-2.

Figure 3:
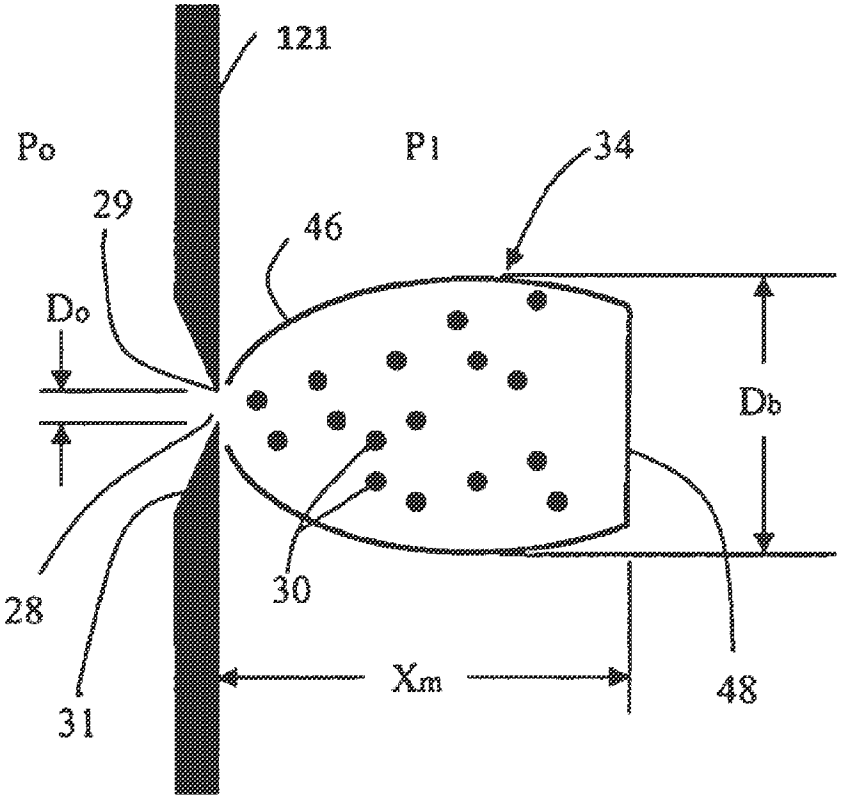
FIG. 3 is a detailed schematic view of an exemplary inlet aperture, the ions and the supersonic free jet expansion according to various aspects of the present teachings.

To help understand how at least a portion of the ions 30 can be radially confined, focused and transmitted between the inlet and exit apertures 31, 32, reference is now made to FIG. 3. The adiabatic expansion of a gas, from a nominal high-pressure P0 region, into a region of finite background pressure P1, forms an unconfined expansion of a supersonic free gas jet 34 (also known as a supersonic free jet expansion. The inlet aperture 31 can be where the expansion of the gas through the orifice or nozzle can be divided into two distinct regions based upon the ratio of the flow speed to the local speed of sound. In the high-pressure P0 region, the flow speed near the orifice or the nozzle is lower than the local speed of sound. In this region the flow can be considered subsonic. As the gas expands from the inlet aperture 31 into the background pressure P1, the flow speed increases while the local speed of sound decreases. The boundary where the flow speed is equal to the speed of sound is called the sonic surface. This region is referred to as the supersonic region, or more commonly the supersonic free jet expansion. The shape of the aperture influences the shape of the sonic surface. When the aperture 31 can be defined as a thin plate, the sonic surface can be bowed out towards the P1 pressure region. The use of an ideally shaped nozzle, conventionally comprising a converging-diverging duct can produce a sonic surface that is flat and lies at the exit of the nozzle. The converging portion can also be conveniently defined by a chamfer 31 surface, while the volume of the first vacuum chamber 121 can define the diverging portion.

A minimum area location of the converging-diverging duct is often referenced as the throat 29. The diameter of the minimum area or the throat 29 is shown using reference Do on FIG. 3. The velocity of the gas passing through the throat 29 becomes "choked" or "limited" and attains the local speed of sound, producing the sonic surface, when the absolute pressure ratio of the gas through the diameter Do is less than or equal to 0.528. In the supersonic free jet 34, the density of the gas decreases monotonically and the enthalpy of the gas from the high-pressure P0 region is converted into directed flow. The gas kinetic temperature drops and the flow speed exceeds that of the local speed of sound (hence the term supersonic expansion).

As shown in FIG. 3, the expansion can comprise a concentric barrel shock 46 and terminated by a perpendicular shock known as the Mach disc 48. As the ions 30 enter the first vacuum chamber 121 through the inlet aperture 31, they are entrained in the supersonic free jet 34 and since the structure of the barrel shock 46 defines the region in which the gas and ions expand, virtually all of the ions 30 that pass through the inlet aperture 31 are confined to the region of the barrel shock 46. It is generally understood that the gas downstream of a Mach disc 48 can re-expand and form a series of one or more subsequent barrel shocks and Mach discs that are less well-defined compared to the primary barrel shock 46 and primary Mach disc 48. The density of ions 30 confined in the subsequent barrel shocks and Mach discs, however, can be correspondingly reduced as compared to the ions 30 entrained in the primary barrel shock 46 and the primary Mach disc 48.

The supersonic free jet expansion 34 can be generally characterized by the barrel shock diameter Db, typically located at the widest part as indicated in FIG. 3, and the downstream position Xm of the Mach disc 48, as measured from the inlet aperture 31, more precisely, from the throat 29 of the inlet aperture 31 producing the sonic surface. The Db and Xm dimensions can be calculated from the size of the inlet aperture, namely the diameter Do, the pressure at the ion source P0 and from the pressure P1 in the vacuum chamber 121, as described, for example, in the paper by Ashkenas, H., and Sherman, F. S., in deLeeuw, J. H., Editor of Rarefied Gas Dynamics, Fourth Symposium IV, volume 2, Academic Press, New York, 1966, p. 84:

$$D_b = 0.412 \times D_0 \times \sqrt{\frac{P_0}{P_1}}, \tag{1}$$

$$X_m = 0.67 \times D_0 \times \sqrt{\frac{P_0}{P_1}}, \tag{2}$$

where P0 is the pressure around the ion source 22 region 24 upstream of the inlet aperture 31 and P1 is the pressure downstream of the aperture 31 as described above. For example, if the diameter of the inlet aperture 31 is approximately 0.6 mm, with a suitable pumping speed so that the pressure in the downstream vacuum chamber 121 is about 2.6 Torr, and the pressure in the region of the ion source 22 is about 760 Torr (atmosphere), from equation (1), the predetermined diameter of the barrel shock Db is 4.2 mm with a Mach disc 48 located at approximately 7 mm downstream from the throat 29 of the inlet aperture 31, as calculated from equation (2).

The supersonic free jet expansion 34 and barrel shock structure 46 expanding downstream from the throat 29 of the inlet aperture 31 can be an effective method of transporting the ions 30 and confining their initial expansion until the ions 30 are well within the volume 37 of the ion guide 106. The fact that all of the gas and ions 30 are confined to the region of the supersonic free jet 34, within and around the barrel shock 46, means that a large proportion of the ions 30 can be initially confined to the volume 37 of the ion guide 36 if the ion guide 36 is designed to accept the entire or nearly the entire free jet expansion 34. Additionally, the ion guide 36 can be positioned at a location so that the Mach disc 48 can be within the volume 37 of the ion guide 36. By locating the ion guide 106 downstream of the inlet aperture 31, and in a position to include essentially all of the diameter Db of the free jet expansion 34, a larger inlet aperture 31 can be used and thus a higher vacuum chamber 121 pressure P1 can be used while maintaining high efficiency in radially confining and focusing the ions 30 between the apertures 31, 32 thereby to allow more ions into the second vacuum chamber 122.

Accordingly, with the appropriate RF voltage, ion guide dimensions and vacuum pressure, not only can the ion guide 106 provide radial ion confinement, but the ion guide 106 can also be effective to focus at least a portion of the ions 30 while the ions 30 traverse the internal volume between the inlet 31 and exit 32 apertures, as described, for example, in U.S. Pat. No. 4,963,736, the contents of which are incorporated herein by reference. Although the function of the ion guide 106 can be described to provide both radial confinement and focusing of the ions, it is not essential that the ion guide 106 perform the ion focusing effect. Greater efficient ion transmission between the inlet and exit apertures 31, 32, however, can be achieved with the focusing capabilities of the ion guide 106.

In the example described above, where the barrel shock 46 diameter Db is approximately 4.2 mm and the position Xm of the Mach disc 48, measured from the throat of the inlet aperture 31, is about 7 mm, the predetermined cross-section of the ion guide 106 (in this instance, an inscribed circle of diameter D) can be about 4 mm in order for all or essentially all of the confined ions 30 in the supersonic free gas jet 34 to be contained within the volume 37 of the ion guide 106. An appropriate length for the ion guide 106 greater than 7 mm can be chosen so that effective RF ion radial confinement can be achieved. This can result in maximum sensitivity without the necessity of increasing the vacuum pumping capacity and thus the cost associated with larger pumps.

As described above and in accordance with equations (1) and (2), the pressure P1 within the vacuum chamber 121 containing the ion guide 106 can contribute to the characterization of the supersonic free jet 34 structure. If the pressure P1 is too low, then the diameter Db of the barrel shock 46 is large, and the ion guide 106 can require substantial practical efforts to be large enough to confine the ions 30 entrained by the supersonic free jet expansion 34. Consequently, if a large inscribed diameter D can be sized accordingly to a large barrel shock diameter Db, then larger voltages must be used in order to provide effective ion radial confinement and ion focusing. However, larger voltages can cause electrical breakdown and discharge, which can interfere with proper function of the ion guide and can introduce considerable complexity to the instrument for safe and reliable operation. Additionally, power supplies capable of providing large voltages tend to be priced high, which can drive up the cost of commercial instruments. Therefore, it is most effective to keep the pressure relatively high so as to keep the jet diameter small and to keep the diameter D of the ion guide as small as possible so that voltages are maintained below electrical breakdown.

Conversely, if the pressure P1 is too high, then the focusing action of the ion guide 106 is reduced. In the embodiments disclosed herein, the pressure P1 of the first vacuum chamber 121 of the mass spectrometer system 100 is maintained at a pressure ranging from approximately 100 mTorr to approximately 50 Torr. For example, in some aspects, the first vacuum chamber 121 can be maintained at a pressure above about 500 mTorr. In certain implementations, the first vacuum chamber can be maintained at a pressure in a range from about 0.5 Torr to about 10 Torr. Alternatively or additionally, the first vacuum chamber can be maintained at a pressure ranging from about 10 Torr to about 50 Torr.

Referring back to FIG. 1, the multipole ion guide 106 can comprise a quadrupole rod set 130 and a plurality of auxiliary electrodes 140 extending along a portion of the multipole ion guide 106 and interposed between the rods of the quadrupole rod set 130 such that upon application of various RF and/or DC potentials to the components of the multipole ion guide 120, ions of interest are collisionally cooled (e.g., in conjunction with the pressure of vacuum chamber 121) and transmitted through the exit aperture 32 (shown in FIG. 2) into the downstream mass analyzers for further processing, while unwanted ions can be neutralized within the multipole ion guide 106 (e.g., radially ejected from the volume defined by the quadrupole rod set 130, thereby reducing a potential source of contamination and/or interference in downstream processing steps. The vacuum chamber 121, within which the multipole ion guide 106 is housed, can be associated with a mechanical pump (42, shown in FIG. 2) operable to evacuate the chamber to a pressure suitable to provide collisional cooling. For example, as noted above, the vacuum chamber can be evacuated to a pressure approximately in the range of about 100 mTorr to about 50 Torr, though other pressures can be used for this or for other purposes. A lens 107 can be disposed between the vacuum chamber of Q0 and the adjacent chamber to isolate the two chambers 121, 122.

In accordance with various aspects of the present teachings, it will also be appreciated that the example ion guides described herein can be disposed in a variety of front-end locations of mass spectrometer systems. By way of non-limiting example, the ion guide 108 can serve in the conventional role of a QJet® ion guide (e.g., operated at a pressure of about 1-10 Torr), focusing ion guide preceded by a QJet® ion guide, as a combined Q0 focusing ion guide and QJet® ion guide (e.g., operated at a pressure of about 3-15 mTorr), or as an intermediate device between a the QJet® ion guide and Q0 (e.g., operated at a pressure in the 100 s of mTorrs, at a pressure between a typical QJet® ion guide and a typical Q0 focusing ion guide).

Figure 4B:
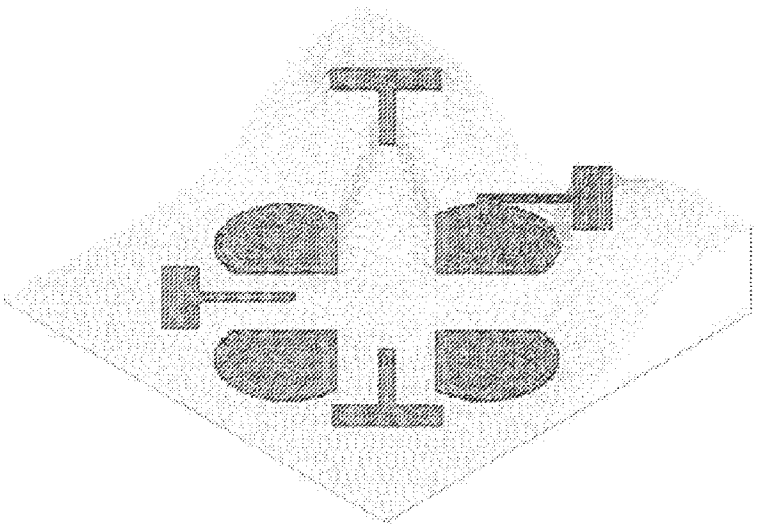
FIGS. 4A-C are schematic illustrations of an exemplary multipole ion guide according to various aspects of the present teachings, with potential energy and equipotential field lines illustrated by the multipole ion guide based on exemplary exemplary signals applied to the rods and electrodes of the ion guide.
Figure 4C:
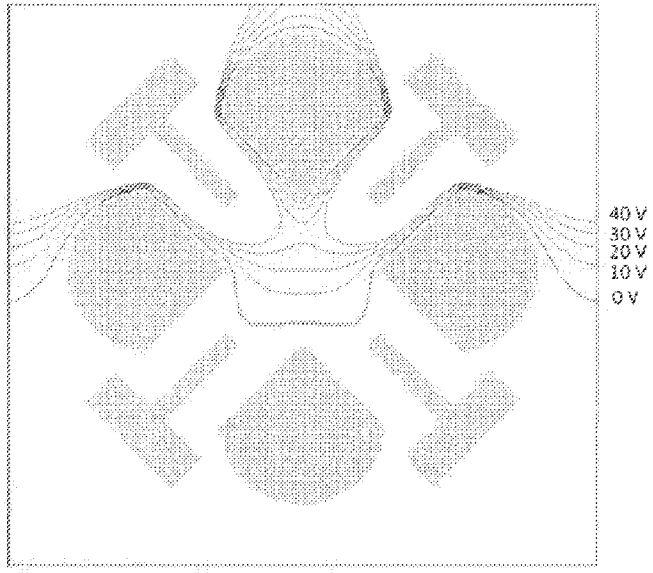
Figure 4A:
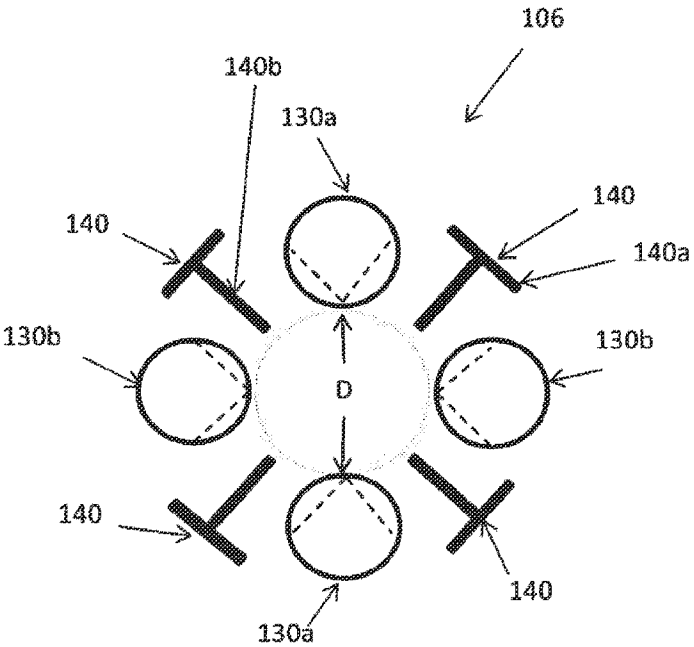

FIGS. 4A-C is a schematic illustration of the multipole ion guide 106 of FIG. 1, with potential energy (FIG. 4B) and equipotential field lines (FIG. 4C) being depicted based on exemplary signals applied to the rods and electrodes of the ion guide 106. As shown in FIG. 4A, the ion guide 106 can comprise two elongated rod sets 130*a*, 130*b* (e.g., a quadrupole rod set) and a plurality of auxiliary electrodes 140*a*, 140*b*. In the example shown in FIG. 4A, the multipole ion guide is 106 is depicted in a cross-sectional schematic view, across the location of the auxiliary electrodes 140 depicted in FIG. 1. As shown, the multi-pole ion guide 106 can generally comprise a set of rods (e.g., two pairs of rods 130*a*, 130*b* in the example shown in FIG. 4A) that extend from a proximal inlet end, disposed adjacent the inlet orifice 31, to a distal outlet end, disposed adjacent the exit aperture 32. The rods 130*a*, 130*b* surround and extend along the central axis of the ion guide 106 (not shown), thereby defining a space through which the ions are transmitted. It will be appreciated that though the elongated rods 130 of the ion guide 106 are generally referred to herein as quadrupoles (e.g., four rods), the plurality of elongated rods can be any other suitable multi-pole configurations, for example, hexapoles, octopoles, etc. It will also be appreciated that the one or more ion guides or mass analyzers can be any of triple quadrupoles, linear ion traps, quadrupole time of flights, Orbitrap or other Fourier transform mass spectrometers, all by way of non-limiting example.

Each of the rods 130*a*, 130*b* that form the quadrupole rod set 130 can be coupled to an RF power supply such that the rods on opposed sides of the central axis together form a rod pair to which a substantially identical RF signal is applied. That is, the rod pair 130*a* can be coupled to a first RF power supply that provides a first RF voltage to the first pair of rods 130*a* at a first frequency and in a first phase. On the other hand, the rod pair 130*b* can be coupled to a second RF power supply that provides a second RF voltage at a second frequency (which can be the same as the first frequency), but opposite in phase to the RF signal applied to the first pair of rods 130*a*. As will be appreciated by a person skilled in the art, a DC offset voltage can also be applied to the rods 130*a*, 130*b* of the quadrupole rod set 130.

The rods 130*a*, 130*b* can assume various shapes and profiles. In various aspects, each of the plurality of rods can exhibit a non-circular cross section at their proximal end and a circular cross-section at their distal end. For example, at least one rod can have a tapered profile along the longitudinal axis of the ion guide 106. The tapering in the profile of the rods 130*a*, 130*b* increases the spacing between the rod pairs 130*a*, 130*b*, which can allow for the initial expansion of the gas that confines the ions of interest. This expansion of the gas increases the radial expansion of the ions, and particularly the low m/z ions, such that the ions having lower m/z are subjected to increased strength of the electric field generated by the auxiliary electrodes 140 as discussed further below. In certain implementations, the rods 130*a*, 130*b* can be configured such that they have a half-round-half-square profile near the inlet aperture of the vacuum chamber in which the ion guide is disposed. The rods can further be configured to assume this half-round-half-square shape for a certain length along the length of the ion guide. For example, the rods can be configured to assume the half-round-half-square shape for approximately 8.5 centimeters (cm) along the length of the ion guide. Alternatively or additionally, the rods can initially assume a tapered shape, while for the remainder of the length of the electrode, they assume a cylindrical shape. For example, the rods can assume a cylindrical shape for the last 4.0 cm along the length of the ion guide. As noted above, this change in the profile of rods results in an increase in space among the rods and can in some aspects increase the radial expansion of the gas.

The exemplary multipole ion guide 106 depicted in FIG. 4A additionally includes a plurality of auxiliary electrodes 140 interposed between the rods of the quadrupole rod set 130 that also extend along the central axis, the auxiliary electrodes 140 generally configured to overlay an asymmetric DC electric field (relative to the general radially-confining RF field generated by the quadrupole rod set 130) that is configured to deflect the ions, and particularly low m/z ions from their average trajectory along the central longitudinal axis. As shown in FIG. 4A, for example, each auxiliary electrode 140 can be separated from another auxiliary electrode 140 by a rod 130*a*, 130*b* of the quadrupole rod set 130. Further, each of the auxiliary electrodes 140 can be disposed adjacent to and between a rod 130*a* of the first pair and a rod 130*b* of the second pair. Each of the auxiliary electrodes 140 can be coupled to a DC power supply (e.g., power supply 197 of FIG. 1) for providing an auxiliary electrical signal to the auxiliary electrodes 140 that can selectively control or manipulate the transmission of ions from the multipole ion guide 120.

A variety of auxiliary DC electrical signals can be applied to the auxiliary electrodes 140 so as to preferentially, radially deflect the low m/z ions. Generally, ions having lower m/z would be subjected to increased radial spreading during the free jet expansion and can be more easily deflected by the DC field generated by the auxiliary electrodes. By way of example, the DC electrical signal can be of the same or different polarity as the polarity of ions to be filtered (e.g., the low m/z ions) such that the auxiliary electrodes remove (e.g., radially deflect, repel, attract) the low m/z ions from within the volume confined by the quadrupole field such that these ions are prevented from being transmitted into downstream components. Though a DC voltage equal to the DC offset voltage applied to the rods of the quadrupole rod set 130*a,b* can be applied to the auxiliary electrodes 140 so as to deflect the ions from the central longitudinal axis, in some aspects, a DC voltage applied to the electrodes 140 can be selected to be greater than the DC offset on the quadrupole rods so as to increase the effect of the high-pass filter. By way of non-limiting example, the auxiliary electrodes 140 can be maintained at a DC potential in a range of about 0 V to about ±350 V relative to the QJet ion guide rod offset, while the quadrupole rods in the QJet ion guide are typically maintained at a DC offset voltage of about ±10 V in a triple quadrupole MS system, by way of non-limiting example. For a time-of-flight QTOF MS system, the DC offset voltage for the quadrupole rods in a QJet ion guide are typically maintained in a range from about 10V to about 200V (or −10V to about −200V). With reference now to FIGS. 4B-C, the potential energy (FIG. 4B) and equipotential field lines (FIG. 4C) are depicted for exemplary DC signals applied to the rods 130 and the "active" electrodes 140 of the ion guide 106. As modeled in FIGS. 4B-C, the rods 130 are maintained at a DC offset voltage of −10 V, while a +50 V DC signal is applied to each of the two, active electrodes 140. The other "non-active" electrodes 140 are grounded. As shown, cations within the volume defined by the rods 130 would be subject to repulsion by the DC electric field generated by the application of these exemplary DC signals to the "active" electrodes 140, thus tending to deflect the ions away from the central longitudinal axis of the ion guide 106 (e.g., toward the "non-active" electrodes). It will further be appreciated in view of the present teachings that the identity (e.g., based on the low m/z cutoff) and/or amount of ions that are prevented from entering downstream components can depend on various factors including the ion population, the size of the electrodes, and the voltage applied to the electrodes. Accordingly, it will be appreciated in view of the present teachings that the DC potential applied to the auxiliary electrodes 140 can be adjusted (e.g., under the influence of the controller) so as to adjust the filtering aspects of the ion guide 106. Further, although shown as including two auxiliary electrodes 140, any number of electrodes can be utilized. For example, in other implementations and as shown in FIG. 5A, the multiple ion guide can include three auxiliary electrodes.

The auxiliary electrodes 140 can have a variety of shapes (e.g., round, T-shaped, thin bars, blade electrodes), though T-shaped electrodes can be preferred as the extension of the stem 140*b* toward the central axis of the ion guide 120 from the rectangular base 140*a* allows the innermost conductive surface of the auxiliary electrode to be disposed closer to the central axis (e.g., to increase the strength of the field within the ion guide 120). The T-shaped electrodes can have a substantially constant cross section along their length such that the innermost radial surface of the stem 140*b* remains at a substantially constant distance from the central axis along the entire length of the auxiliary electrodes 140. Though round auxiliary electrodes (or rods of other cross-sectional shapes) can also be used. However, such electrodes generally exhibit a smaller cross-sectional area relative to the quadrupole rods 130*a*, 130*b* due to the limited space between the quadrupole rods 130*a*, 130*b* and/or require the application of larger auxiliary potentials due to their increased distance from the central axis.

The auxiliary electrodes 140 can have a variety of lengths and in some aspects need not extend along the entire length of the quadrupole rods 130*a*, 130*b*. For example, the auxiliary electrodes 140 can have a length less than half of the length of the quadrupole rod set 130 (e.g., less than 33%, less than 10%). Whereas the rod electrodes of a conventional QJet ion guide can have a length along the longitudinal axis in a range from about 10 cm to about 30 cm, the auxiliary electrodes 140 can have a length of 10 mm, 25 mm, or 50 mm, all by way of non-limiting example. Moreover, the auxiliary electrodes 140 can be positioned more proximal or more distal relative to the inlet 31 and outlet 32 apertures. For example, the auxiliary electrodes 140 can be disposed at any of the proximal third, the middle third, or the distal third of the quadrupole rod set 130. When using auxiliary electrodes 140 having shorter lengths, the quadrupole rod set 130*a*, 130*b* can accommodate multiple sets of auxiliary electrodes 140 at various positions along the central axis. For example, it is within the scope of the present teachings that the mass spectrometer system 100 can include a first, proximal set of auxiliary electrodes to which a first auxiliary electrical signal can be applied (e.g., a DC voltage different from the DC offset voltage of rods 130*a,b*) and one or more distal sets of auxiliary electrodes to which a second auxiliary electrical signal can be applied (e.g., DC voltage).

Figure 5B:
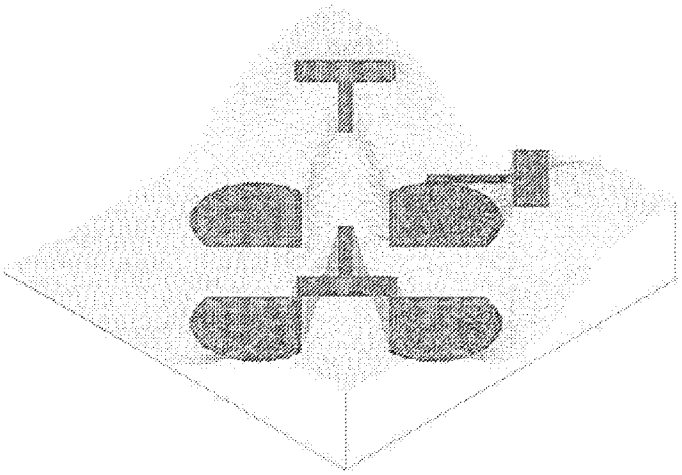
FIGS. 5A-C are schematic illustrations of another exemplary multipole ion guide according to various aspects of the present teachings, with potential energy and equipotential field lines illustrated by the multipole ion guide based on exemplary exemplary signals applied to the rods and electrodes of the ion guide.
Figure 5C:
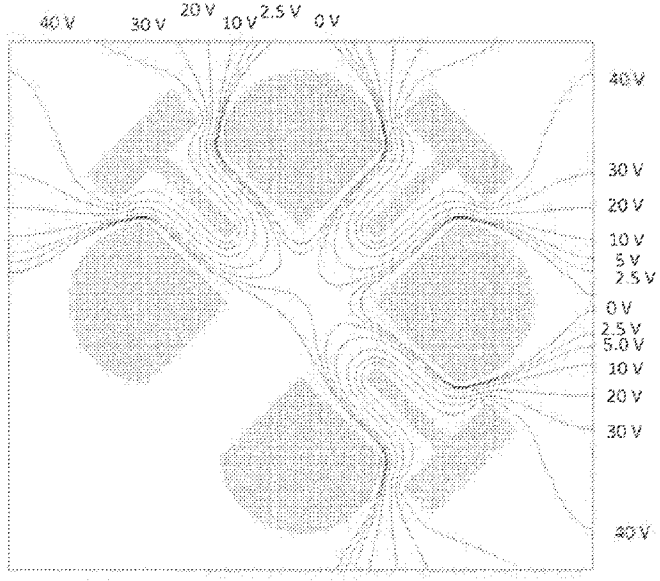
Figure 5A:
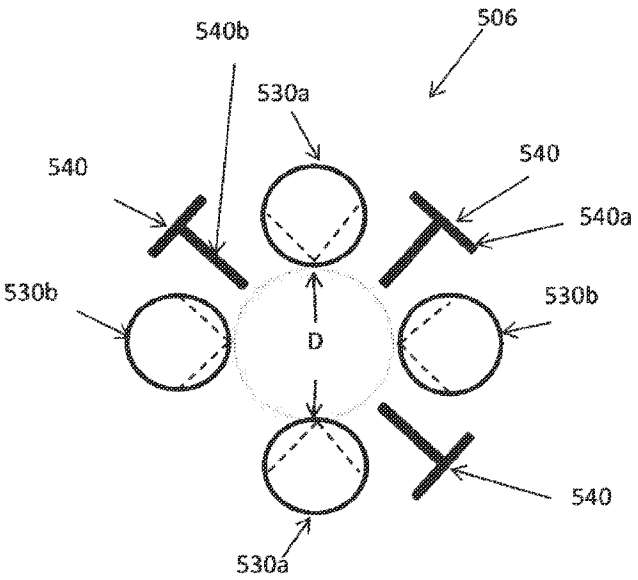

With reference now to FIGS. 5A-C, another exemplary ion guide 506 in accordance with various aspects of the present teachings is schematically depicted as viewed from the inlet end, with potential energy (FIG. 5B) and equipotential field lines (FIG. 5C) being depicted based on exemplary signals applied to the rods and electrodes of the ion guide 506. The exemplary ion guide 506 depicted in FIG. 5A is substantially similar to ion guide 106 shown in FIG. 4A, but differs in that the ion guide 506 comprises three T-shaped electrodes 540 having a base portion 540*a* and a stem portion 540*b* extending therefrom. The electrodes 540 can be, for example 10 mm in length and have a stem 540*b* approximately 6 mm in length. Additionally, the auxiliary electrodes 540 can be coupled to a mounting ring that can, in turn, be mounted to a desired location of the quadrupole rod set 530. By way of non-limiting example, the mounting ring can comprise notches for securely engaging the rods of the quadrupole rod set 530. A single lead can couple the auxiliary electrodes 540 to a DC power supply (not shown) such that a substantially identical auxiliary electrical signal can be applied to each of the auxiliary electrodes 540 in accordance with various aspects of the present teachings as otherwise discussed herein. With reference now to FIGS. 5B-C, the potential energy (FIG. 5B) and equipotential field lines (FIG. 5C) are depicted for an exemplary DC signal applied to the rods 530 and the three T-shaped electrodes 540 of the ion guide 506. As modeled in FIGS. 5B-C, the rods 530 are maintained at a DC offset voltage of −10 V, while a +50 V DC signal is applied to each of the three electrodes 540. As shown, cations within the volume defined by the rods 530 would be subject to repulsion by the DC electric field generated by the application of these exemplary DC signals to the electrodes 540, thus tending to deflect the ions away from the central longitudinal axis of the ion guide 506.

As noted above, systems and methods in accordance with various aspects of the present teachings can reduce contamination in the downstream components of a mass spectrometry system can act as a high-pass filter by selectively filtering the ions that travel through the mass spectrometer based on their m/z, and preventing ions having a low m/z that fall out of the desired range from going through the downstream elements of spectrometer. Specifically, the electrical voltage applied to the rods and the auxiliary electrodes can be controlled to ensure that the ions having m/z that below a desired range of interest can be deflected and/or repelled by the DC field generated by the electrodes and, thereby, prevented from being transferred into and/or contaminating the downstream sections of the mass spectrometer. For example, an RF voltage having a first frequency and a first phase component can be applied to a first pair of rods. Another RF voltage having the same frequency as the first frequency and a second phase can be applied to at least one other pair of rods. The auxiliary electrodes can also receive a DC voltage from the power supply. The DC voltage applied to the auxiliary electrodes can be configured such that it is of the same polarity as the polarity of ions that are not of interest and should be filtered (e.g., low mass cations). This causes the auxiliary electrodes to repel the ions that are not of interest and prevent them from entering into other components (e.g., downstream components) of the mass spectrometer and contaminating those components. Generally, ions having lower mass to charge ratios are more easily deflected. Further, the amount of ions that are deflected (prevented from entering other components of the mass spectrometer) can depend on various factors including the ion population, the size of the electrodes, and the voltage applied to the electrodes. Any number of auxiliary electrodes can be used with the embodiments disclosed herein. For example, in some implementation 2 or 3 auxiliary electrodes can be utilized. The auxiliary electrodes can have similar polarities as the ions being filtered. For example, if the auxiliary electrodes are positively charged, they can repel positive ions of low mass/density ratios and prevent these ions from entering the downstream components of the spectrometer. Although positive ions of higher mass/density ratios are also repelled, since these ions have larger mass/charge densities, the repelling force exerted by the auxiliary electrodes would not be able to prevent these ions from entering into the cavity of the ion guide. Accordingly, by controlling the voltage and polarity of the auxiliary electrodes, embodiments disclosed herein can selectively allow ions of interest (e.g., ions having certain mass/charge densities) to enter the cavity of the ion guide.

As noted above, substantial fouling of components contained within the downstream chambers of a mass spectrometer (e.g., QJet ion guide, Q0, $IQ_1$, etc., described with reference to FIG. 1) can have significant effects on the effective operation of a mass spectrometer system (e.g., by causing loss of sensitivity, increased noise, etc.). The present disclosure can reduce the ion transmission during non-analytical periods of an MS experiment can result in a significant reduction in contamination of the downstream elements, and thus, can increase throughput, improve robustness, and/or decrease the downtime typically required to service (e.g., vent/disassemble/clean) mass spectrometer systems.

Figure 6:
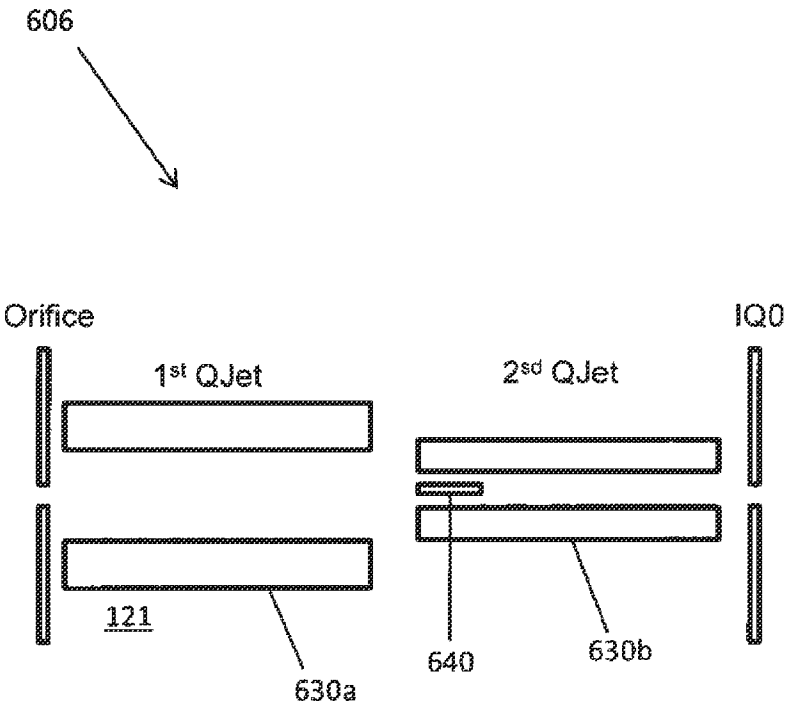
FIG. 6 schematically depicts another exemplary multipole ion guide suitable for use in the mass spectrometer system of FIG. 1 according to various aspects of the present teachings.
Figure 7A:
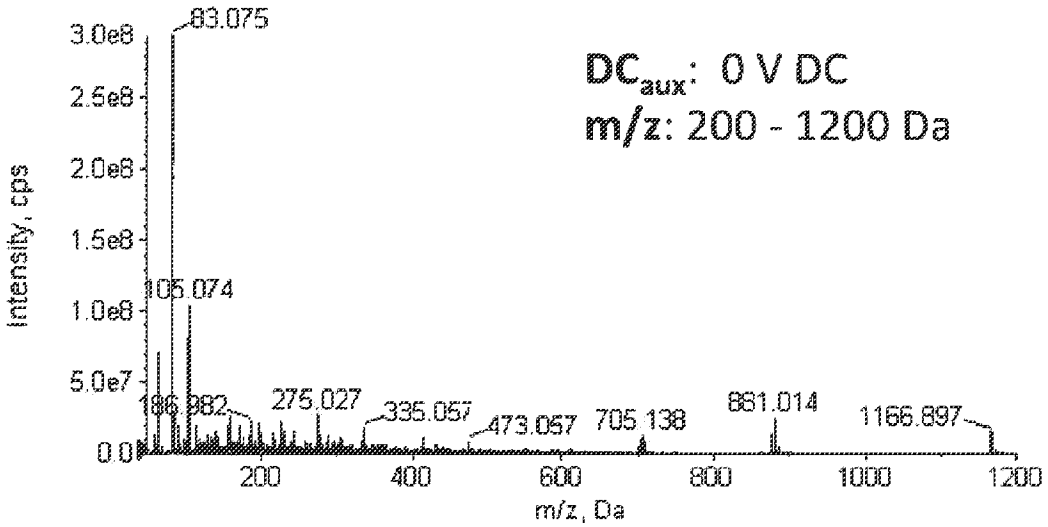
FIGS. 7A-7F depict exemplary experimental mass spectra obtained by a mass spectrometer system for processing ions in accordance with various aspects of the present teachings.
Figure 7B:
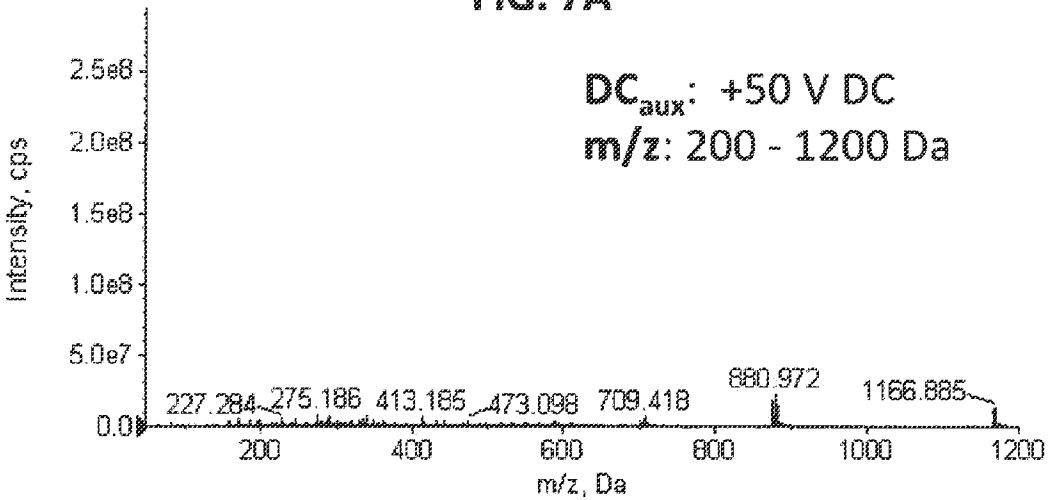
Figure 7C:
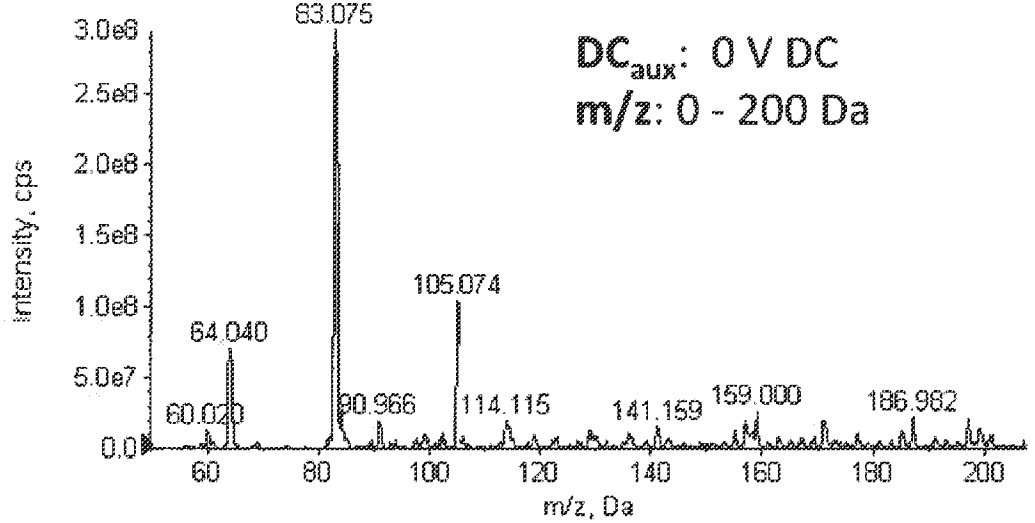
Figure 7D:
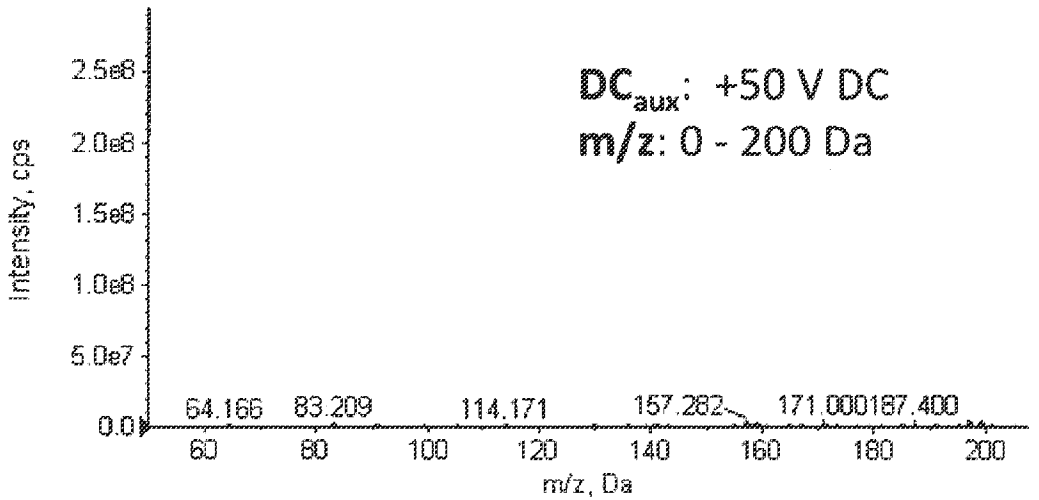
Figure 7E:
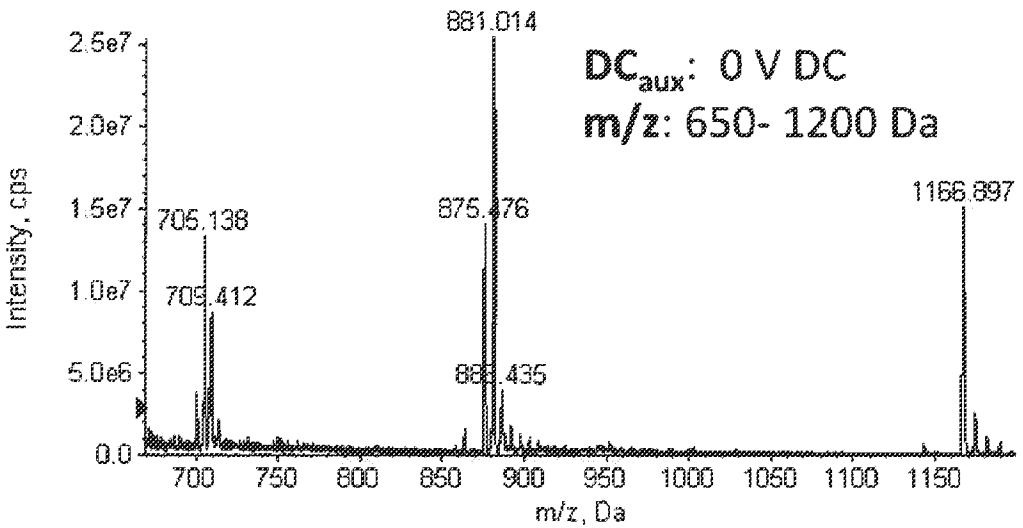
Figure 7F:
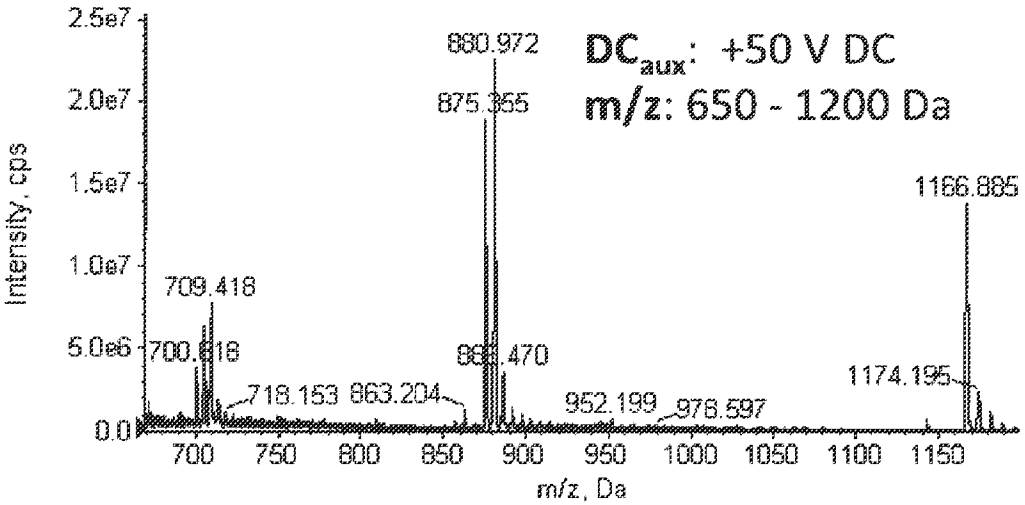

FIG. 6 schematically illustrates another exemplary ion guide 606 of a mass spectrometer according to various aspects of the present teachings. As shown in FIG. 6 the multipole ion guide 606 comprises a double QJet ion guide, as generally described in U.S. Pat. No. 7,259,371, the entire teachings of which is incorporated herein by reference, and modified in accordance with the present teachings. As shown, the double QJet ion guide employs an upstream ion guide 630*a* and a downstream ion guide 630*b* disposed in series in the high-pressure chamber 121. The two QJet ion guides 630*a,b* have been coupled to one another in series and arranged such that the second Q-jet ion guide promotes expansion of the gas used to entrain the ions of interest. Specifically, the second QJet ion guide utilizes a half square/half round profile in its first portion (e.g., its first 20.5 mm) and has a cylindrical profile for the rest of its length, which can be, for example, 31 mm. This half-square/half round profile along with the cylindrical portion allows for formation of space for expansion of the gas, which carries the ions of interest. As shown, the auxiliary electrodes 640 as otherwise discussed herein are also positioned in the second QJet ion guide 630*b*.

FIGS. 7A-7F depict examples of the mass spectra generated by a mass spectrometer system utilizing a prototype of the ion guide 506 schematically depicted in FIG. 5A while processing insulin ions in accordance with various aspects disclosed herein. To generate the chromatogram shown in FIGS. 7A and 7B, three auxiliary electrodes 540 were used with a DC voltage of 0 V DC applied thereto (FIG. 7A, i.e., such that the ion guide substantially functioned as a conventional collimating quadrupole) and a DC voltage of +50 V DC (FIG. 7B) for preventing the transmission of low m/z ions in accordance with various aspects of the present teachings. Comparing FIGS. 7A and 7B, it will be observed that there is significant attenuation for many low-m/z ions when a repulsive DC voltage of +50V DC is applied to the three auxiliary electrodes. For example, with reference to FIGS. 7C-7D, which represent a zoomed in version of FIGS. 7A-7B, respectively, for the m/z range of about 0 Da to about 200 Da, the visible peaks represent the signal when a DC of 0V was applied to the auxiliary electrodes. It will be noted that the signal for a signal of 50 V DC is barely visible, indicating that the m/z ions below about 200 Da have been significantly attenuated (e.g., >>90%). However, with reference now to FIGS. 7E and 7F, which represent a zoomed in version of FIGS. 7A-7B, respectively, for the m/z range of about 650 Da to about 1200 Da, the chromatograms are substantially identical regardless if the signal applied to the auxiliary electrodes 540 was 0 V DC or +50 V DC. It will thus be appreciated that the +50 V DC electrical signal applied to the auxiliary electrodes enabled the ion guide to behave as a high pass filter in which low m/s ions were substantially prevented from being transmitted to the detector, while the detection of the relatively higher m/z ions were largely unaffected.

Figure 8:
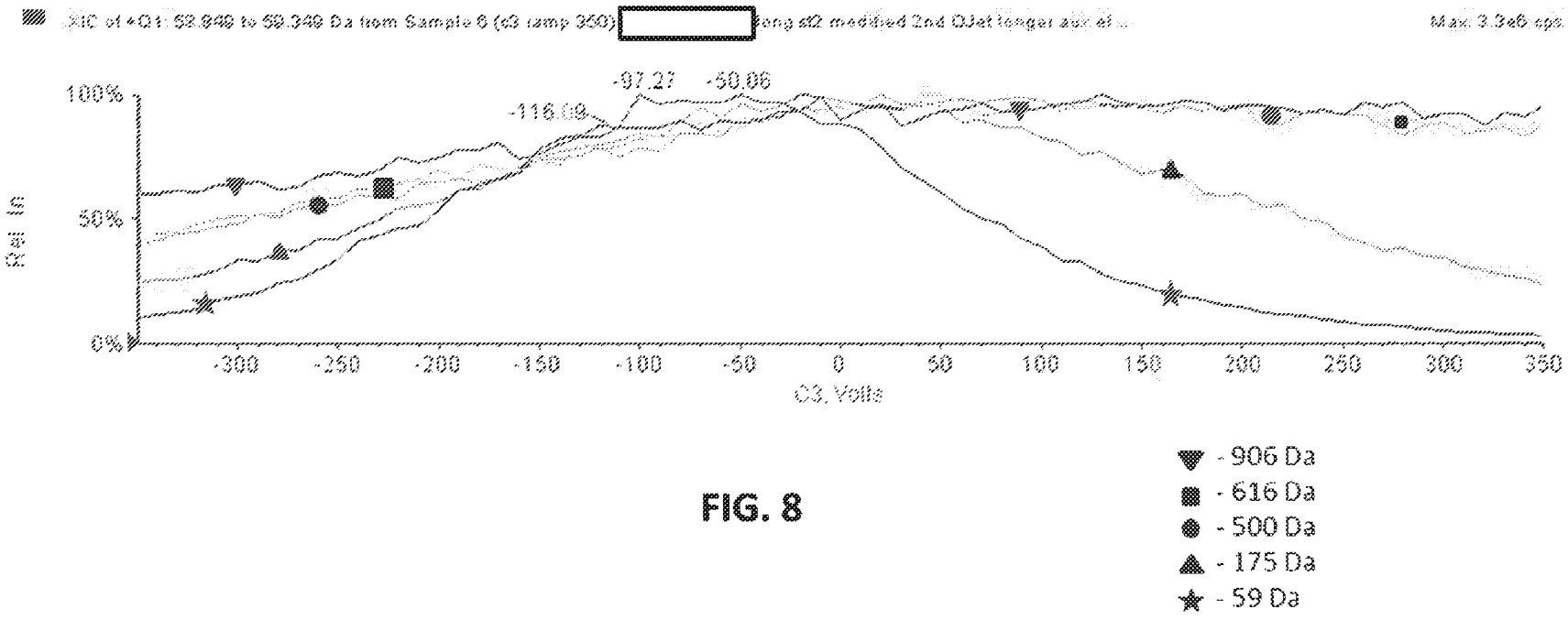
FIG. 8 depict examples of the mass spectra generated by a mass spectrometer system for processing ions in accordance with various aspects of the present teachings.

FIG. 8 depicts additional exemplary mass spectra generated by a mass spectrometer system for processing ions in accordance with various aspects of the present teachings while utilizing a PPG 2e-7 solution. In this exemplary system, four auxiliary electrodes were provided, with only two adjacent auxiliary electrodes being energized with a non-zero DC voltage at a time while the remaining auxiliary electrodes were held at ground (e.g., such that the ion guide substantially functioned as the ion guide discussed above with reference to FIG. 4A). To generate the plot, the intensity of five m/z were monitored (i.e., 906 Da, 616 Da, 500 Da, 175 Da, and 59 Da) as the DC auxiliary signal applied to the two adjacent energized electrodes was scanned from about −350 V DC to about 350 V DC. It will first be noted that at about 0 V DC, the relative intensity of each ion (the intensity of the ion at that particular DC voltage relative to its max intensity over the scan range) were all well above 100%, indicating that the ion guide was substantially functioning as a conventional collimating quadrupole. At −350 V DC, however, the lower mass ions was largely attenuated (more than 90%), with the relative intensity of the other ions increasing as their m/z increased. As shown, the 906 Da ions exhibited about a 60% relative intensity at −350 V DC. As will be appreciated by a person skilled in the art in light of the present teachings, this data indicates that an asymmetric attractive potential can likewise be effective to deflect the low m/z ions from the central longitudinal axis and prevent their transmission. Rather than repel the ions, however, the DC auxiliary potential of opposite polarity would attract the ions. Finally, at +350 V DC, the lower 59 Da ions were nearly 100% attenuated, with the relative intensity of the other ions increasing as their m/z increased at +350 V DC. It will this be appreciated that the DC electrical signal applied to the auxiliary electrodes can be selected to enable the ion guide to behave as a high pass filter, with the level of attenuation being able to be adjusted in particular for lower m/z ions, while the detection of the relatively higher m/z ions is less affected.

It should be appreciated that for clarity, the description presented herein will explicate various aspects of embodiments disclosed herein, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person should recognize that some embodiments described herein do not necessarily require certain aspects of the specifically described details in every implementation, which are set forth herein only to provide a thorough understanding of the embodiments. Similarly it will be apparent that the described embodiments can be susceptible to alteration or variation according to common general knowledge without departing from the scope of the disclosure. The following detailed description of embodiments is not to be regarded as limiting the scope of the applicant's teachings in any manner.

Those skilled in the art will know or be able to ascertain using no more than routine experimentation, many equivalents to the embodiments and practices described herein. By way of example, the dimensions of the various components and explicit values for particular electrical signals (e.g., amplitude, frequencies, etc.) applied to the various components are merely exemplary and are not intended to limit the scope of the present teachings. Accordingly, it will be understood that the invention is not to be limited to the embodiments disclosed herein, but is to be understood from the following claims, which are to be interpreted as broadly as allowed under the law.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

What is claimed is:

1. A mass spectrometer, comprising:

an ion source configured to generate ions, from a sample of interest, in a high pressure region;

a first ion guide disposed within a free jet expansion chamber maintained at a pressure above about 500 mTorr, the free jet expansion chamber extending between an inlet aperture, configured to receive the ions generated by the ion source from the high pressure region, and an exit aperture, positioned downstream from said inlet aperture and configured to transmit at least a portion of said ions from the free jet expansion chamber to a second vacuum chamber maintained at a lower pressure relative to the free jet expansion chamber;

wherein said at least one ion guide comprises:

a first plurality of rods comprising at least a first pair of rods and a second pair of rods, extending along a central longitudinal axis from a proximal end disposed adjacent the inlet aperture to a distal end, the plurality of rods being spaced apart from the central longitudinal axis and configured to define an internal volume within which the ions received through the inlet aperture are entrained by a flow of gas;

a plurality of auxiliary electrodes extending along at least a portion of the ion guide, each of the auxiliary electrodes being interposed between a single rod of the first pair of rods and a single rod of the second pair of rods; and a power supply coupled to the ion guide, the power supply being configured to provide a first RF voltage at a first frequency and a first phase to the first pair of rods and a second RF voltage at the first frequency and a second phase to the second pair of rods for radially confining the ions within the internal volume, the power supply being further configured to provide an auxiliary electrical signal to at least one of the auxiliary electrodes to radially deflect from the internal volume at least a portion of low mass-to-charge ratio (m/z) ions so as to prevent transmission of said low m/z ions through the exit aperture.

2. The mass spectrometer of claim 1, wherein the power supply is configured to apply one of a substantially identical DC voltage to each auxiliary electrode and a DC voltage to at least one auxiliary electrode different from a DC voltage applied to the other auxiliary electrodes.

3. The mass spectrometer of claim 1, wherein the DC voltage applied to each auxiliary electrode is at least one of the same or different polarity as the low m/z ions and different from a DC offset voltage at which the plurality of rods are maintained.

4. The mass spectrometer of claim 1, further comprising a controller configured to increase repulsion of the low m/z ions by attenuating the low m/z ions transmitted from the ion guide by adjusting the DC voltage applied to the auxiliary electrodes relative to the DC offset voltage at which the plurality of rods are maintained.

5. The mass spectrometer of claim 1, further comprising a controller configured to adjust a m/z range of ions transmitted from the ion guide by adjusting the DC voltage applied to the auxiliary electrodes.

6. The mass spectrometer of claim 1, wherein the plurality of rods comprises a quadrupole rod set.

7. The mass spectrometer of claim 1, wherein the first vacuum chamber is maintained at a pressure in a range from about 0.5 Torr to about 50 Torr.

8. The mass spectrometer of claim 1, further comprising a mass analyzer configured to receive ions transmitted from the free jet expansion chamber.

9. The mass spectrometer of claim 1, wherein the auxiliary electrodes have a length less than a length of rods of the plurality of rods.

10. The mass spectrometer of claim 1, further comprising a second ion guide disposed downstream from the first ion guide within the free jet expansion chamber and along the central longitudinal axis, the second ion guide comprising a second plurality of rods extending between a proximal end disposed adjacent the distal end of the first plurality of rods and a distal end disposed adjacent the exit aperture.

11. The mass spectrometer of claim 10, wherein the second ion guide comprises a quadrupole rod set.

12. The mass spectrometer of claim 10, wherein a distal end of the plurality of auxiliary electrodes is proximal to the proximal end of the second plurality of rods.

13. The mass spectrometer of claim 1, wherein the plurality of auxiliary electrodes exhibit a T-shaped cross-sectional shape.

14. The mass spectrometer of claim 1, wherein each of the plurality of rods exhibit a non-circular cross section at their proximal end and a circular cross-section at their distal end.

15. The mass spectrometer of claim 1, wherein the plurality of rods comprise a half-round-half-square profile near the inlet aperture of the vacuum chamber.

16. A method for performing mass spectrometry analysis, the method comprising:

generating ions, from a sample of interest, in a high pressure region;

receiving the ions generated by the ion source in a free jet expansion chamber maintained at a pressure above about 500 mTorr, the free jet expansion chamber including at least one ion guide disposed within the free jet expansion chamber between an inlet aperture of the free jet expansion chamber and the exit aperture of the free jet expansion chamber, the at least one guide comprising:

a plurality of rods comprising at least a first pair of rods and a second pair of rods, extending along a central longitudinal axis from a proximal end disposed adjacent the inlet aperture to a distal end, the plurality of rods being spaced apart from the central longitudinal axis and defining an internal volume within which the ions received through the inlet aperture are entrained by a flow of gas; and a plurality of auxiliary electrodes extending along at least a portion of the ion guide, each of said auxiliary electrodes being interposed between a single rod of the first pair of rods and a single rod of the second pair of rods;

providing a first RF voltage at a first frequency and a first phase to the first pair of rods and a second RF voltage at the first frequency and a second phase to the second pair of rods for radially confining the ions within the internal volume;

providing an auxiliary electrical signal to at least one of the auxiliary electrodes to selectively radially deflect from the internal volume at least a portion of low mass-to-charge (m/z) ions so as to prevent transmission of said low m/z ions through the exit aperture; and transmitting at least a portion of remaining ions from the free jet expansion chamber to a second vacuum chamber maintained at a lower pressure relative to the first vacuum chamber for further processing.

17. The method of claim 16, wherein providing the auxiliary electrical signal to at least one of the auxiliary electrodes comprises at least one of applying a substantially identical electric DC voltage to each auxiliary electrode and applying to at least one auxiliary electrode a DC voltage different from a DC voltage that is applied to the other auxiliary electrodes.

18. The method of claim 16, wherein providing the auxiliary electrical signal to at least one of the auxiliary electrodes comprises applying DC voltage of same or different polarity as the low m/z ions to each auxiliary electrode.

19. The method of claim 16, further comprising increasing repulsion of the low m/z ions by attenuating the low m/z ions transmitted from the ion guide by adjusting the DC voltage applied to the auxiliary electrodes relative to the DC offset voltage at which the plurality of rods are maintained.

20. The method of claim 16, further comprising maintaining the free jet expansion chamber at a pressure in a range from about 0.5 Torr to about 50 Torr.

21. The method of claim 16, further comprising maintaining the free jet expansion chamber at a pressure in a range from about 10 Torr to about 50 Torr.

* * * * *